US006554074B2

(12) United States Patent
Longbottom

(10) Patent No.: US 6,554,074 B2
(45) Date of Patent: Apr. 29, 2003

(54) LIFT FLUID DRIVEN DOWNHOLE ELECTRICAL GENERATOR AND METHOD FOR USE OF THE SAME

(75) Inventor: Jim Robert Longbottom, Magnolia, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/800,290

(22) Filed: Mar. 5, 2001

(65) Prior Publication Data

US 2002/0121377 A1 Sep. 5, 2002

(Under 37 CFR 1.47)

(51) Int. Cl.[7] ..... E21B 43/00; E21B 4/04
(52) U.S. Cl. ..... 166/372; 166/66.5; 166/66.4
(58) Field of Search ..... 166/65.1, 66.4, 166/66.5, 66.6, 66.7, 244.1, 372; 290/1 A, 2, 52; 415/129, 131, 202, 903, 904

(56) References Cited

U.S. PATENT DOCUMENTS

| | | | | | |
|---|---|---|---|---|---|
| 4,118,637 | A | | 10/1978 | Tackett | 290/55 |
| 4,132,269 | A | | 1/1979 | Chasteen | 166/268 |
| 4,184,545 | A | | 1/1980 | Claycomb | 166/113 |
| 5,417,281 | A | * | 5/1995 | Wood et al. | 166/68 |
| 5,813,469 | A | * | 9/1998 | Bowlin | 166/68 |
| 5,839,508 | A | | 11/1998 | Tubel et al. | 166/65.1 |
| 6,032,737 | A | | 3/2000 | Brady et al. | 166/265 |
| 6,138,758 | A | * | 10/2000 | Shaw et al. | 166/372 |
| 6,279,651 | B1 | * | 8/2001 | Schwendemann et al. | 166/54.1 |

* cited by examiner

*Primary Examiner*—Heather Shackelford
*Assistant Examiner*—Brian Halford
(74) *Attorney, Agent, or Firm*—Lawrence R. Youst

(57) ABSTRACT

A lift fluid driven downhole electrical generator and method for generating and controlling the electrical output from the electrical generator is disclosed. The electrical generator comprises a housing having a lift fluid port in a sidewall portion thereof for allowing the flow of lift fluids therethrough. A rotor is rotatably disposed within the housing. The rotor converts lift fluid pressure to rotary motion when the lift fluid travels through the lift fluid port and impinges the rotor. The electrical generator also includes an electromagnetic assembly having a first portion that is rotatable with the rotor and a second portion that is stationary with the housing. The electromagnetic assembly converts the rotary motion to electricity as the first portion of an electromagnetic assembly rotates relative to the second portion of the electromagnetic assembly.

47 Claims, 4 Drawing Sheets

42
40
18
10
20
12
24
22
26
16
30
28
38
32
36
14
34

LIFT FLUID DRIVEN DOWNHOLE ELECTRICAL GENERATOR AND METHOD FOR USE OF THE SAME

TECHNICAL FIELD OF THE INVENTION

The present invention relates in general to a downhole apparatus and method for generating electricity and, in particular to, a downhole electrical generator that uses lift fluid pressure to produce electricity which is used to operate other downhole devices.

BACKGROUND OF THE INVENTION

Without limiting the scope of the invention, its background is described in connection with the operation of downhole electrical devices, as an example. The control and operation of oil and gas production wells constitute an important and ongoing concern of the petroleum industry. As an example, well control has become particularly important and more complex in view of the industry wide development of multilateral wells. Generally speaking, multilateral wells have multiple branches each having discrete production zones which produce fluid into common or independent production tubing. In either case, there is a need for controlling zone production, isolating specific zones and otherwise monitoring each zone in a particular well. As a result, the methods and devices used for controlling wells are growing more complex. In fact, downhole control systems which include downhole computerized modules employing downhole computers for commanding downhole tools such as packers, sliding sleeves and valves are becoming more common.

For example, using downhole sensors, a downhole computer controlled system may monitor actual downhole parameters such as pressure, temperature and flow to automatically execute control instructions based upon the monitored downhole parameters. As should apparent, operating such a well control systems will require electrical power. It has been found, however, that presently known methods of supplying or generating electricity downhole suffer from a variety of problems and deficiencies.

In one method, electricity may be supplied downhole by lowering a tool on a wireline and conducting electricity through one or more conductors in the wireline from the surface to the tool. Similarly, hardwires may be attached on the exterior of the tubing running from the surface to the desired downhole location. These techniques, however, are not desirable due to their cost and complexity. In addition, in deep wells, there can be significant energy loss caused by the resistance or impedance in the wires.

Downhole electrical circuits utilizing batteries housed within a downhole assembly have also been attempted. These batteries, however, can only provide moderate amounts of electrical energy at the elevated temperatures encountered downhole. In addition, batteries have relatively short lives requiring frequent replacement and/or recharging.

Other attempts have been made to provide a downhole mechanism which continuously generates and supplies electricity. For example, systems using radioisotopes, fuel cells and piezoelectric techniques have been attempted. These systems, however, have raised safety and environmental concerns, are expensive and complex and/or do not generate suitable amounts of electricity.

A more promising approach to supplying electricity downhole appears to be the use of downhole electrical generators. Previous attempts to operate downhole generators, however, have met with limited success. Specifically, many downhole generators are installed within the tubing string which prevents the passage of other tools or equipment therethrough. Other downhole generators have been proposed that are installed in side pockets thus allowing passage of equipment through the tubing.

All of these downhole generators, however, suffer from a serious drive problem. Specifically, the turbines of these downhole generators are rotated by the upward flow of production fluids. Not only does this create an undesirable pressure drop in the production fluids, but use of production fluids to drive turbines significantly limits the life expectancy of these downhole generators. Specifically, the mechanical and chemical qualities of production fluids tend to erode and corrode the turbine as well as other components of these downhole generators. In addition, tars and suspended solids in the production fluid tend to clog flow passageways within these downhole generators and prevent proper rotation of the rotors. Also, the amount of the electrical output of these production fluid driven downhole generators is controlled by the flow rate of production fluid through the tubing which is dependent, in part, upon the pressure in the formation which decreases over time.

Therefore, a need has arisen for a downhole generator that is not driven by the flow of production fluids through the tubing. A need has also arisen for such a downhole generator that does not cause a pressure drop within the production fluids. Further, a need has arisen for such a downhole generator wherein the electrical output is not dependent upon the pressure in the formation from which the production fluids are produced.

SUMMARY OF THE INVENTION

The present invention disclosed herein comprises a lift fluid driven downhole electrical generator that does not use the flow of formation fluids to drive a turbine. As such, the lift fluid driven downhole electrical generator of the present invention does not choke the flow of formation fluids up through the tubing. In addition, the electrical output of the lift fluid driven downhole electrical generator of the present invention is not dependent upon the flow rate of formation fluids or the pressure in the formation from which the formation fluids are produced.

Broadly characterized, the lift fluid driven downhole electrical generator, once positioned downhole in a tubing string, converts the lift fluid pressure into electricity. For example, the lift fluid may be used to create rotary motion by impinging the lift fluid against a rotor. The rotary motion may then be converted to electricity by rotating a first portion of an electromagnetic assembly relative to a second portion of the electromagnetic assembly.

The lift fluid driven downhole electrical generator comprises a housing having one or more lift fluid ports in a sidewall portion thereof for receiving the lift fluid from the annulus surrounding the tubing string. A flow control device that is slidably disposed within the housing is used to selectively allow and prevent the flow of lift fluid through the lift fluid port. The openness of the lift fluid port may be controlled by the operation of an actuator that is operably coupled to the flow control device. The actuator may infinitely vary the openness of the lift fluid port between the fully open and fully closed positions in response to a signal from the surface received by a downhole telemetry system, a signal from a downhole sensor or a timer. Alternatively, a controller may be used to monitor the electrical output of the downhole generator and then send a signal to adjust the position of the flow control device relative to the lift fluid port to vary the electrical output of the downhole generator if desired.

When the lift fluid ports are open, a rotor, rotatably disposed within the housing, converts the lift fluid pressure to rotary motion as the lift fluid impinges the rotor. The rotation of the rotor is imparted on the first portion of the electromagnetic assembly which is rotatable relative to the second portion of the electromagnetic assembly, which is stationary with the housing. This relative rotation within the electromagnetic assembly converts the rotary motion to electricity. The first portion of the electromagnetic assembly includes a plurality of electrical windings wrapped around a core. One end of the electrical windings is electrically coupling to a first portion of a commutator and the other end of the electrical windings is electrically coupling to a second portion of the commutator. The second portion of the electromagnetic assembly includes magnets and at least two contact members that are stationary with the housing of the downhole electrical generator. In operation, when the first portion of the electromagnetic assembly is rotated relative to the second portion of the electromagnetic assembly, a first contact member sequentially engages the first portion of the commutator then the second portion of the commutator while a second contact member simultaneously sequentially engages the second portion of the commutator then the first portion of the commutator. As such, electricity is generated by the lift fluid driven downhole electrical generator of the present invention.

In addition, the present invention may be used to control the electrical output of a lift fluid driven downhole electrical generator. This is achieved by positioning the downhole electrical generator within a tubing string, injecting a lift fluid down an annulus surrounding the tubing string, providing a fluid communication path through the downhole electrical generator by varying the position of a flow control device relative to a lift fluid port, communicating lift fluid through the lift fluid port, rotating a rotor and an electromagnetic assembly such that electricity is generated in response to the flow of lift fluid through the fluid communication path, sensing the generated electricity to determine the electrical output of the downhole electrical generator and adjusting the flowrate of lift fluid through the fluid communication path by selectively varying the position of the flow control device relative to the lift fluid port, thereby controlling the electrical output of the downhole generator.

More specifically, the step of sensing the generated electricity to determine the electrical output of the downhole electrical generator may include receiving a signal indicative of the magnitude of the electricity being generated with a controller, processing the signal in the controller and generating a control signal with the controller to vary the position of the flow control device relative to the lift fluid port.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
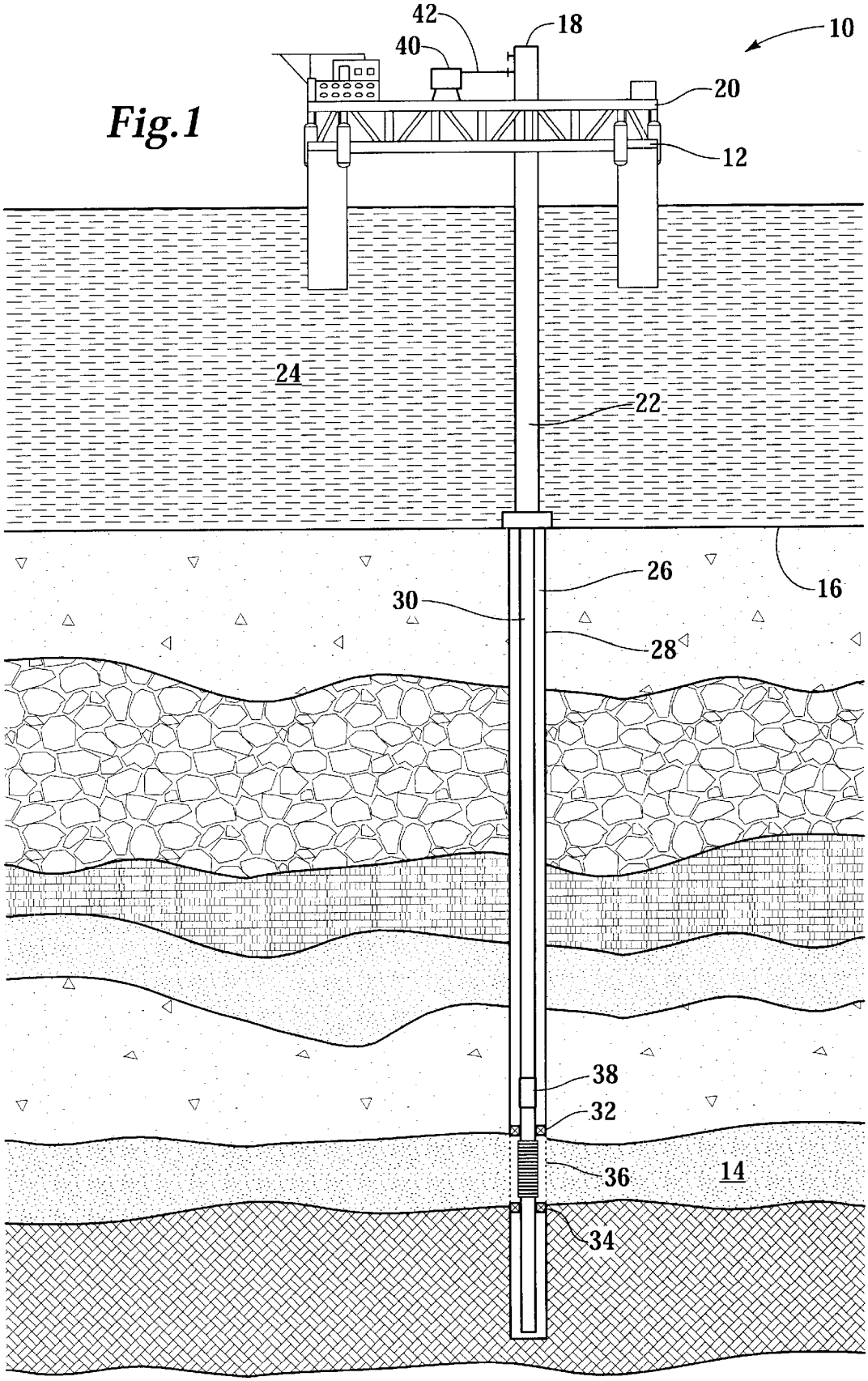
FIG. 1 is a schematic illustration of an offshore oil and gas production platform operating a lift fluid driven downhole electrical generator of the present invention.

Referring to FIG. 1, an offshore oil and gas production platform operating a lift fluid driven downhole electric generator is schematically illustrated and generally designated 10. A semi-submersible platform 12 is centered over a submerged oil and gas formation 14 located below sea floor 16. Wellhead 18 is located on deck 20 of platform 12. Well 22 extends through the sea 24 and penetrates the various earth strata including formation 14 to form wellbore 26. Disposed within wellbore 26 is casing 28. Disposed within casing 28 and extending from wellhead 18 is production tubing 30. A pair of seal assemblies 32, 34 provide a seal between tubing 30 and casing 28 to prevent the flow of production fluids therebetween. During production, formation fluids enter wellbore 26 through perforations 36 in casing 28 and travel into tubing 30 to wellhead 18.

Coupled within tubing 30 is a lift fluid driven downhole electrical generator 38. Downhole electrical generator 38 is driven by lift fluid communicated thereto from surface installation 40, through fluid conduit 42 and the annulus between casing 28 and tubing 30 as will be explained in greater detail below.

In addition, the lift fluid may be used to enhance the recovery of hydrocarbons from formation 14 by decreasing the hydrostatic head of the column of formation fluid in wellbore 26. Decreasing the hydrostatic head enhances recovery by reducing the amount of pressure required to lift the formation fluids to the surface. Decreasing the density of the column of fluid extending from formation 14 to the surface reduces the hydrostatic head of this fluid column. As such, mixing a lower density fluid into the formation fluids reduces the overall density of the fluid column and consequently decreases the hydrostatic head. Accordingly, low density fluids, including liquids such as a hydraulic fluid or gases may be used.

Even though FIG. 1 depicts a vertical well, it should be noted by one skilled in the art that the present invention is equally well-suited for slanted wells, deviated wells or horizontal wells. Also, even though FIG. 1 depicts an offshore operation, it should be noted by one skilled in the art that the present invention is equally well-suited for use in onshore operations.

Figure 2:
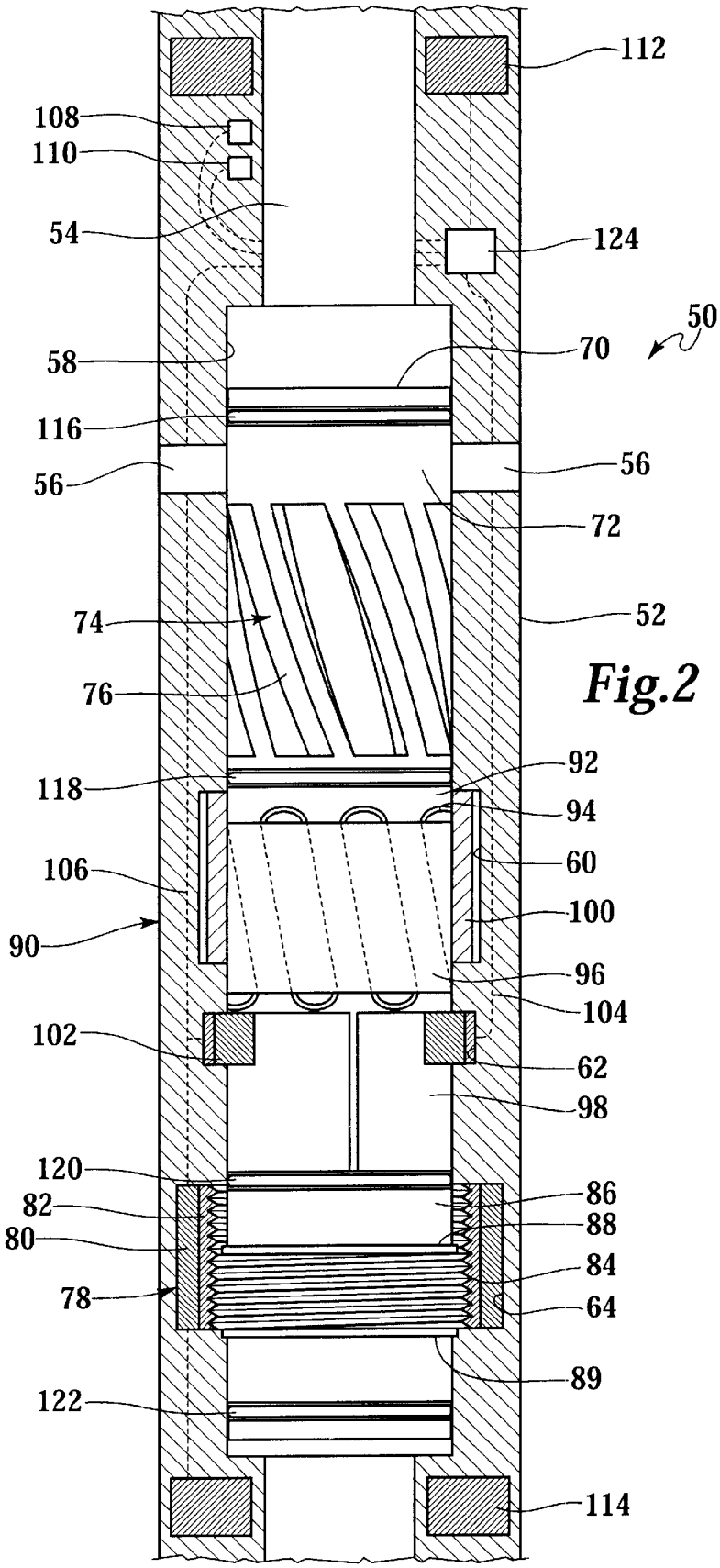
FIG. 2 is a partial cross sectional view of a lift fluid driven downhole electrical generator of the present invention in its closed position.

Referring now to FIG. 2, therein is depicted a lift fluid driven downhole electrical generator of the present invention that is generally designated 50. Generator 50 has an outer housing 52 that is a substantially cylindrical tubular member that is threadedly and sealingly coupled to tubing string 30, as seen in FIG. 1, at its upper and lower ends. It should be apparent to those skilled in the art that the use of directional terms such as top, bottom, above, below, upper, lower, upward, downward, etc. are used in relation to the illustrative embodiments as they are depicted in the figures, the upward direction being toward the top of the corresponding figure and the downward direction being toward the bottom of the corresponding figure. As such, it is to be understood that the downhole components described herein may be operated in vertical, horizontal, inverted or inclined orientations without deviating from the principles of the present invention.

Housing 52 has a primary flow passageway 54 extending longitudinally therethrough. Housing 52 also has one or more lift fluid ports 56 radially extending through the side wall thereof. In the illustrated embodiment, multiple ports 56 are disposed around the same circumference of housing 52, however, other ports could be disposed either above or below ports 56 along the length of housing 52 if desired.

Housing 52 can be made of any suitable material, such as metal, plastic or ceramic capable of withstanding the pressures, temperatures and substances downhole. The material for housing 52 may be machined or formed to have a desired shape and size including a radially expanded inner diameter region 58 and interior cavities 60, 62 and 64 for purposes to be described below.

Figure 3:
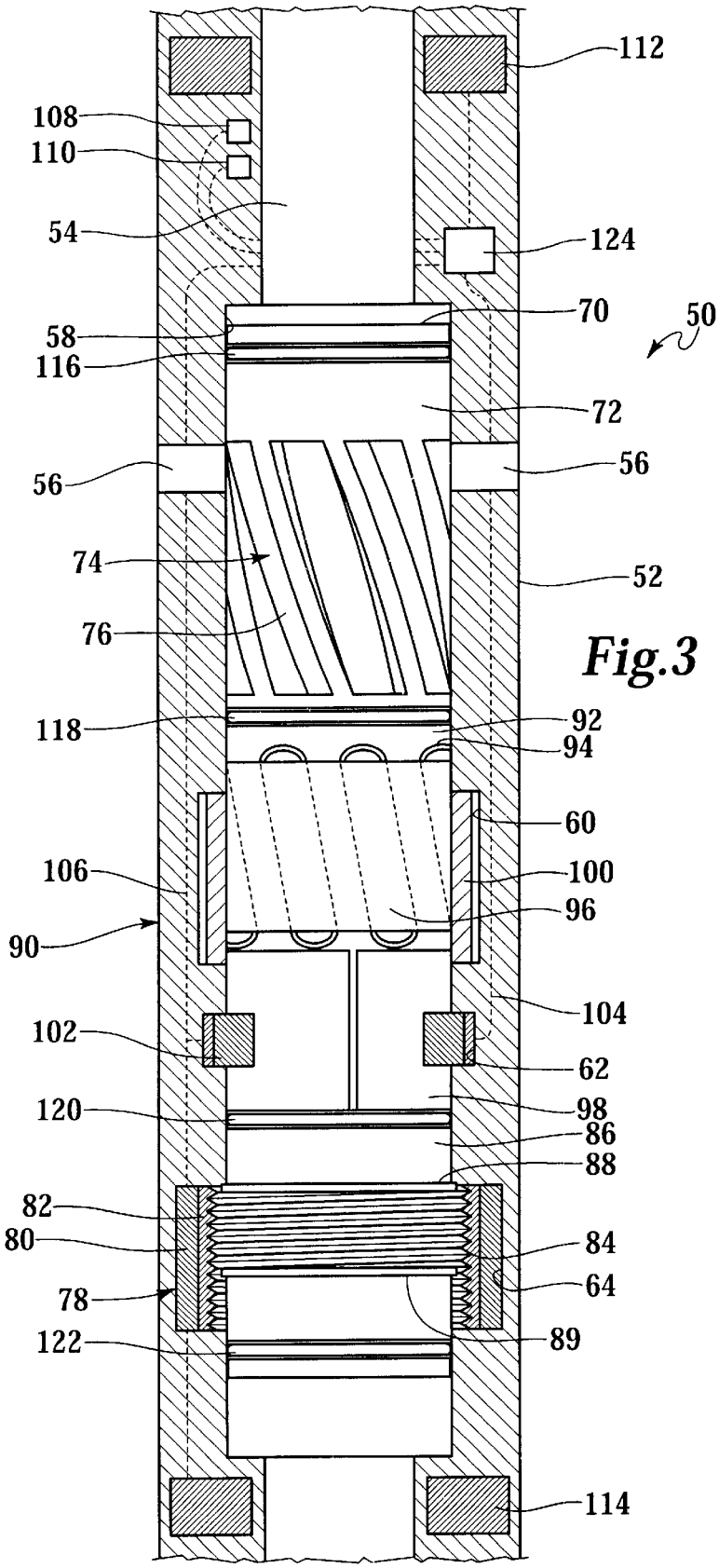
FIG. 3 is a partial cross sectional view of a lift fluid driven downhole electrical generator of the present invention in its fully open position.
Figure 4:
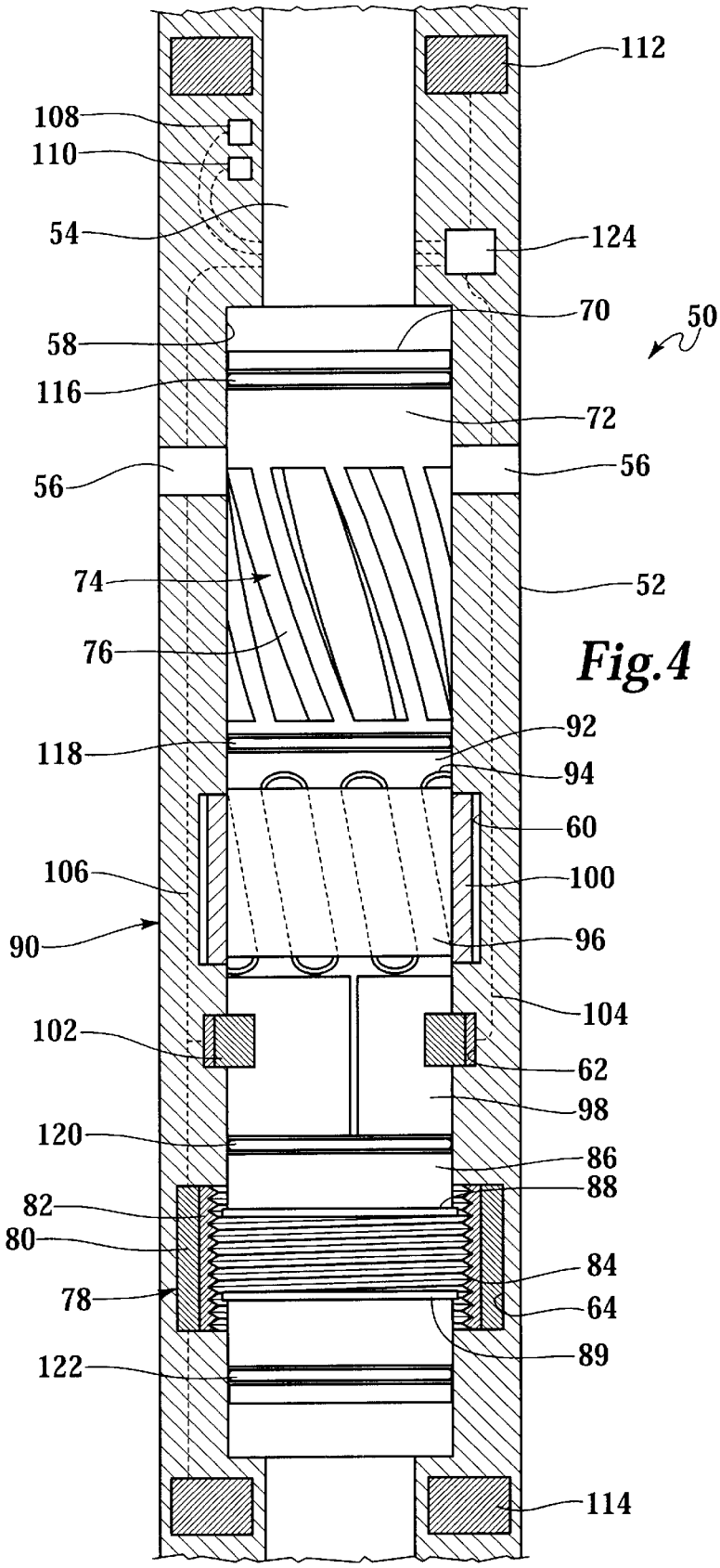
FIG. 4 is a partial cross sectional view of a lift fluid driven downhole electrical generator of the present invention in a partially open position.

Disposed within radially expended inner diameter region 58 of housing 52 is an inner subassembly 70 that is rotatably and axially moveable relative to housing 52. Inner subassembly 70 has a primary flow passageway extending longitudinally therethrough that preferable has the same inner diameter as primary flow passageway 54 of housing 52. Inner subassembly 70 includes a flow control device 72 for selectively allowing fluid flow or preventing fluid flow through ports 56. Flow control device 72 is disposed in housing 52 such that flow control device 72 is moveable between a closed position, fully obstructing ports 56, as best seen in FIG. 2, a fully open position, completely unobstructing ports 56, as best seen in FIG. 3, and a partially open position partially obstructing ports 56, as best seen in FIG. 4. As will be explained below, the position of flow control device 72 is infinitely variable relative to ports 56 such that the electrical output of generator 50 may be controlled.

In the illustrated embodiment, flow control device 72 is an annular body made of a suitable material providing for a bearing seal between the exterior surface of flow control device 72 and the interior surface of housing 52, such as a metal-to-metal seal. As illustrated, the height of flow control device 72 is sufficient to overlie ports 56 when ports 56 are to be closed.

Alternatively, instead of using an integral flow control device such as flow control device 72, the flowrate of lift fluid into lift fluid ports 56 may be controlled by lift fluid valves installed within lift fluid ports 72 or in a side pocket mandrel adjacent thereto. The openness of the lift fluid valves may be controlled using known techniques, but are preferably electrically controlled.

Inner subassembly 70 includes a rotor 74 that provides an interface with the lift fluid whereby rotor 74 is driven by the lift fluid entering generator 50 through ports 56. Rotor 74 is used to convert fluid flow to mechanical power. Specifically, rotor 74 is connected to flow control device 72 such that as flow control device 72 opens ports 56, flow of a lift fluid into ports 56 impinges rotor 74 to rotate rotor 74. In one embodiment, the connection between rotor 74 and flow control device 72 is such that both move linearly and rotate together. In another embodiment, joint linear movement occurs but rotor 74 can rotate relative to flow control device 72 using, for example, a sealed bearing coupling.

In the illustrated embodiment, rotor 74 has two degrees of motion. Rotor 74 can rotate about its longitudinal axis and rotor 74 can move linearly or axially within housing 52. In the illustrated embodiment, this linear movement occurs simultaneously with and in conjunction with the longitudinal movement of flow control device 72. As illustrated, flow control device 72 and rotor 74 are linearly disposed and adjoin each other within radially expended inner diameter region 58 of housing 52.

Rotor 74 of the illustrated embodiment has a cylindrical squirrel cage configuration comprising a plurality of angled vanes 76 that are circumferentially separated such that the spaces between vanes 76 permit radial fluid flow between the outside and the inside of rotor 74 and such that an axial channel is defined through rotor 74 to permit axial flow between adjoined vanes 76 as well as through generator 50. As such, rotor 74 is driven by lift fluid flowing into generator 50 through open ports 56. The resulting mechanical power of rotor 74 is used to generate electricity as explained below.

As mentioned above, rotor 74 and flow control device 72 are connected such that they can be moved linearly within housing 52. In the illustrated embodiment, this movement is caused by an actuator 78. Actuator 78 moves flow control device 72 and rotor 74 linearly to variably adjust the openness of ports 56 and to provide infinite flow control throughout the continuum between fully closed and fully opened.

Actuator 78 is mounted within interior cavity 64 of housing 52 and is coupled to inner subassembly 70 linking actuator 78 with rotor 74. Operation of actuator 78 moves inner subassembly 70, including rotor 74 and flow control device 72 axially within housing 52 to displace flow control device 72 relative to ports 56.

In the illustrated embodiment, actuator 78 includes a motor 80. Motor 80 includes a rotating element 82 having a threaded inner surface which engages a threaded outer surface of a ring 84. Ring 84 is axially fixed with respect to linear movement relative to mandrel 86 of inner subassembly 70 by retaining rings 88, 89. Ring 84 is rotatably coupled on mandrel 86 such that mandrel 86 can rotate inside ring 84. To obtain axial movement, ring 84 is maintained rotationally stationary relative to rotating element 82 of motor 80 so that operation of rotating element 82 drives ring 84 and mandrel 86 up or down as desired.

Alternatively, linear movement of inner subassembly 70 inside housing 52 could be achieved manually using a shifting tool. For example, such a shifting tool can be connected to either end of inner subassembly 70 and operated to mechanically pull or push inner subassembly 70 up or down.

In the illustrated embedment, when actuator 78 has moved flow control device 72 to a partially or fully open position, lift fluid induced rotation of rotor 74 may now occur. Such rotation, in turn, causes operation of an electromagnetic assembly 90. Electromagnetic assembly 90 provides an electrical interface which converts mechanical power to electricity.

Electromagnetic assembly 90 includes a mandrel 92 that provides support for a plurality of electrical windings 94, a plurality of pole pieces 96 and a commutator 98, which are also considered to be part of electromagnetic assembly 90. Mandrel 92 is connected to rotor 74. As illustrated, mandrel 92 and rotor 74 are integral and unitary, being constructed with the same tubing piece. Mandrel 92 is also coupled to mandrel 86.

The plurality of electrical windings 94 are wound on mandrel 92. The plurality of pole pieces 96 are disposed radially outwardly of windings 94 so that pole pieces 96 overlie windings 94. Commutator 98 serves as a brush ring and is connected to electrical windings 94 in a known manner so that one end of windings 94 is connected to one or more electrically parallel segments of commutator 98 and the other end of windings 94 is connected to one or more different electrically parallel segments of commutator 98. Commutator 98 is made of suitable electrically conductive material.

Electromagnetic assembly 90 also includes a plurality of magnets 100 mounted within interior cavity 60 of housing 52 such that magnets 100 interact with electromagnetic fields generated by electrical windings 94. The position of cavity 60, and thus of magnets 100 within cavity 60, is such that magnets 100 and pole pieces 96 are substantially aligned throughout the linear travel of inner subassembly 70 within housing 52.

Electromagnetic assembly 90 also includes a plurality of contacts 102 mounted within interior cavity 62 of housing 52. In the illustrated embodiment, contacts 102 are electrically conductive members such as brushes, that overlie and engage respective segments of commutator 98. At least one contact 102 engages one section of commutator 98 connected to one end of windings 94 and at least one other contact 102 engages a different section of commutator 98 connected to the other end of windings 94. Contacts 102 and commutator 98 are sized sufficiently so that electrical contact is made throughout the linear movement of inner subassembly 70 relative to housing 52. Contacts 102 provide an interface to electrical wires such as wires 104, 106. Electricity generated by the present invention travels within wires 104, 106. This electricity can be used for powering devices for sensing parameters of the production fluid such as temperature, pressure, flow, density and the like using downhole sensors 108, 110. Likewise, the electricity may be used to power a downhole telemetry system 112 that may communicate with the surface via pressure pulses, acoustics, electromagnetic waves or other suitable wireless techniques. In addition, the electricity may be used to recharge batteries 114.

To keep the lift fluid within the rotor section of inner subassembly 70 and to isolate the electrical components of electromagnetic assembly 90 from the lift fluid, the illustrated embodiment includes three seals. An O-ring seal 116 is mounted in a groove defined around the upper end of flow control device 72. This places seal 116 above ports 56. Seal 116 provides a fluid seal between flow control device 72 and the inner surface of housing 52.

An O-ring seal 118 is mounted in a groove in mandrel 92 near the juncture of rotor 74 and mandrel 92. Seal 118 provides a fluid seal between mandrel 92 and the inner surface of housing 52 between cavity 60 and ports 56. This places seal 118 below ports 56, and thus on the opposite side of ports 56 from seal 116, thereby limiting the axial travel of the lift fluid therebetween.

O-ring seal 120 is mounted in a groove on mandrel 86 between commutator 98 and upper retaining ring 88 of actuator 78. Seal 120 provides a fluid seal between mandrel 86 and the inner surface of housing 52 between cavities 62, 64.

An additional O-ring seal 122 is mounted in a groove on the lower end of inner subassembly 70 to prevent the entry of dirty formation fluids between inner subassembly 70 and housing 52.

Generator 50 can be operated remotely using an onboard controller 124 housed within housing 52. Controller 124 is of any suitable type to provide the necessary control and signal processing associated with the operation of generator 50 such as a microprocessor, however, other types of digital or analog controllers can be used.

In the illustrated embodiment, controller 124 receives electricity from wires 104, 106. Controller 124 can be used to distribute the electricity to the various electrical components associated with generator 50. For example, controller 124 may be used to provide electricity as well as operation information to sensors 108, 110 to obtain reading for pressure, temperature, density, flow rate or similar parameters associated with the production fluids. This information may then be returned to controller 124 and stored in a memory device associated with controller 124. Thereafter, controller 124 may provide electricity and operating parameters to telemetry device 112 such that information received from sensors 108, 110 may be wirelessly sent to the surface via pressure pulses, acoustics, electromagnetic waves or other suitable techniques known in the art. In addition, controller 124 may direct electricity to batteries 114 for storage and later use when, for example, generator 50 is not generating electricity.

Controller 124 may also be used to control the electrical output of generator 50. Specifically, controller 124 may monitor a characteristic of the generated electricity, for example magnitude. This sensed electricity can be correlated to the flow rate of lift fluid through ports 56. As such, the degree of openness of ports 56 may be adjusted to create the desired electrical output. For example, if it is desired to produce more electricity based upon the electricity characteristic monitored by controller 124, then controller 124 can send a signal to actuator 78 to upwardly shift inner subassembly 70 and increase the degree of openness of ports 56. Alternatively, if it is determined by controller 124 that less electricity should be produced, then controller 124 can send a signal to actuator 78 to downwardly shift inner subassembly 70 and decrease the degree of openness of ports 56.

In operation, generator 50 generates electricity by at least partially unobstructing ports 56 by upwardly shifting flow control device 72 such that lift fluid in the annulus outside generator 50 flows through ports 56 into the flow channel inside rotor 74, as best seen in FIG. 4. This is performed in the illustrated embodiment of generator 50 by wirelessly sending a signal from the surface to telemetry system 112 to open ports 56. This signal is sent to controller 124 where it is processed and sent to motor 80. Motor 80 receives electricity from batteries 114 then operates rotating element 82 to axially upwardly shift ring 84. This upwardly moves rotor 74 and flow control device 72 to open ports 56. Alternatively, controller 124 can have an internal timer by which it is programmed to respond at preset time intervals to turn motor 80 on and off. Likewise, controller 124 may prompt motor 80 to operate based upon changes in the production fluid parameters sensed by sensors 108, 110.

The present invention uses feedback regarding the amount of electricity being generated by generator 50 in response to the lift fluid flow through rotor 74 with controller 124. When the electrical signal indicates the desired electrical parameter is being achieved, motor 80 can be de-energized to stop the linear movement of inner subassembly 70. Alternatively, motor 80 can be used to move inner subassembly 70 up and down to, respectively, increase or decrease the electrical output of generator 50 as desired.

When flow control device 72 has at least partially opened ports 56, lift fluid drives rotor 74 which, in turn, rotates windings 94 and pole pieces 96 relative to magnets 100 and rotates commutator 98 relative to contacts 102 such that electricity is generated.

Another aspect of the operation of the present invention is moving flow control device 72, together with rotor 74, to selectively block ports 56. As explained above, these components are moved together axially within housing 52. The axial movement occurs in response to any suitable force which can be internally generated or externally applied. In the illustrated embodiment, motor 80 can be energized to drive inner subassembly 70 downwardly within housing 52 such that flow control device 72 closes ports 56 and prevents lift fluid from entering ports 56.

It should be noted by those skilled in the art that even though the illustrated embodiments have depicted a rotatable electromagnetic assembly as the means for generating electricity, lift fluid could alternatively be used to provide the energy to generate electricity using other types of electricity generating devices including, but not limited to, expandable bladders, vibrating reeds, piezoelectric wafer stacks and the like, all of which are contemplated and considered within the scope of the present invention.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method for controlling the electrical output of a lift fluid driven downhole electrical generator comprising the steps of:

positioning the downhole electrical generator within a tubing string;

injecting a lift fluid down an annulus surrounding the tubing string;

providing a fluid communication path through the downhole electrical generator and communicating lift fluid therethrough;

rotating a rotor and an electromagnetic assembly such that electricity is generated in response to the flow of lift fluid through the fluid communication path;

sensing the generated electricity to determine the electrical output of the downhole electrical generator; and adjusting the flowrate of lift fluid through the fluid communication path, thereby controlling the electrical output of the downhole generator.

2. The method as recited in claim 1 wherein the step of providing a fluid communication path through the downhole electrical generator and communicating lift fluid therethrough further comprises energizing an actuator to vary the position of a flow control device relative to a lift fluid port.

3. The method as recited in claim 2 wherein the step of energizing the actuator to vary the position of the flow control device relative to the lift fluid port further comprises receiving a wireless command signal from the surface with a downhole telemetry system.

4. The method as recited in claim 2 wherein the step of energizing the actuator to vary the position of the flow control device relative to the lift fluid port further comprises generating a command signal in a downhole controller in response to a change in a formation fluid parameter sensed by a downhole sensor.

5. The method as recited in claim 2 wherein the step of energizing the actuator to vary the position of the flow control device relative to the lift fluid port further comprises generating a command signal in a downhole controller based upon a time schedule.

6. The method as recited in claim 2 wherein the step of energizing the actuator to vary the position of the flow control device relative to the lift fluid port further comprises receiving electrical power from a downhole battery.

7. The method as recited in claim 1 wherein the step of rotating a rotor and an electromagnetic assembly such that electricity is generated in response to the flow of lift fluid through the fluid communication path further comprises impinging the lift fluid against vanes of the rotor to convert fluid pressure of the lift fluid to rotary motion of the rotor and the electromagnetic assembly.

8. The method as recited in claim 1 wherein the step of rotating a rotor and an electromagnetic assembly such that electricity is generated in response to the flow of lift fluid through the fluid communication path further comprises rotating electrical windings relative to magnets.

9. The method as recited in claim 8 wherein the step of rotating electrical windings relative to magnets further comprises electrically coupling one end of the electrical windings to a first portion of a commutator and coupling the other end of the electrical windings to a second portion of the commutator.

10. The method as recited in claim 9 further comprising sequentially engaging a first contact member with the first portion of the commutator then the second portion of the commutator while simultaneously sequentially engaging a second contact member with the second portion of the commutator then the first portion of the commutator.

11. The method as recited in claim 1 wherein the step of sensing the generated electricity to determine the electrical output of the downhole electrical generator further comprises receiving a signal indicative of the magnitude of the electricity being generated with a controller, processing the signal in the controller and generating a control signal with the controller to vary the flowrate of the lift fluid.

12. The method as recited in claim 1 wherein the step of adjusting the flowrate of lift fluid through the fluid communication path further comprises infinitely varying the position of a flow control device relative to a lift fluid port between a fully open position and a fully closed position to control the electrical output of the downhole generator.

13. A method for generating electricity downhole with a lift fluid driven downhole electrical generator comprising the steps of:

positioning the downhole electrical generator within a tubing string;

providing fluid pressure by injecting a lift fluid down an annulus surrounding the tubing string;

converting the fluid pressure to rotary motion by impinging the lift fluid against a rotor; and converting the rotary motion to electricity by rotating a first portion of an electromagnetic assembly relative to a second portion of the electromagnetic assembly.

14. The method as recited in claim 13 wherein the step of converting the fluid pressure to rotary motion by impinging the lift fluid against a rotor further comprises providing a fluid communication path through the downhole electrical generator by varying the position of a flow control device relative to a lift fluid port and communicating lift fluid therethrough.

15. The method as recited in claim 14 wherein the step of providing a fluid communication path through the downhole electrical generator by varying the position of a flow control device relative to a lift fluid port and communicating lift fluid therethrough further comprises energizing an actuator to vary the position of the flow control device relative to the lift fluid port.

16. The method as recited in claim 15 wherein the step of energizing the actuator to vary the position of the flow control device relative to the lift fluid port further comprises receiving a wireless command signal from the surface with a downhole telemetry system.

17. The method as recited in claim 15 wherein the step of energizing the actuator to vary the position of the flow control device relative to the lift fluid port further comprises generating a command signal in a downhole controller in response to a change in a formation fluid parameter sensed by a downhole sensor.

18. The method as recited in claim 15 wherein the step of energizing the actuator to vary the position of the flow control device relative to the lift fluid port further comprises generating a command signal in a downhole controller based upon a time schedule.

19. The method as recited in claim 15 wherein the step of energizing the actuator to vary the position of the flow control device relative to the lift fluid port further comprises receiving electrical power from a downhole battery.

20. The method as recited in claim 13 wherein the step of converting the rotary motion to electricity by rotating a first portion of an electromagnetic assembly relative to a second portion of the electromagnetic assembly further comprises rotating electrical windings of the first portion of the electromagnetic assembly relative to magnets of the second portion of the electromagnetic assembly.

21. The method as recited in claim 20 wherein the step of rotating electrical windings of the first portion of the electromagnetic assembly relative to magnets of the second portion of the electromagnetic assembly further comprises electrically coupling one end of the electrical windings to a first portion of a commutator and electrically coupling the other end of the electrical windings to a second portion of the commutator.

22. The method as recited in claim 21 further comprising sequentially engaging a first contact member with the first portion of the commutator then the second portion of the commutator while simultaneously sequentially engaging a second contact member with the second portion of the commutator then the first portion of the commutator.

23. The method as recited in claim 13 further comprising the step of sensing the generated electricity to determine the electrical output of the downhole electrical generator.

24. The method as recited in claim 23 wherein the step of sensing the generated electricity to determine the electrical output of the downhole electrical generator further comprises receiving a signal indicative of the magnitude of the electricity being generated with a controller, processing the signal in the controller and generating a control signal with the controller to vary the volume of lift fluid impinging the rotor.

25. The method as recited in claim 24 wherein the step of varying the volume of lift fluid impinging the rotor further comprises selectively varying the position of a flow control device relative to a lift fluid port.

26. The method as recited in claim 25 wherein the step of varying the position of a flow control device relative to a lift fluid port further comprises infinitely varying the position of the flow control device relative to the lift fluid port between a fully open position and a fully closed position.

27. A lift fluid driven downhole electrical generator comprising:

a housing having a lift fluid port in a sidewall portion thereof for allowing the flow of lift fluid therethrough;

a rotor rotatably disposed within the housing for converting lift fluid pressure to rotary motion when the lift fluid passes through the lift fluid port and impinges the rotor; and an electromagnetic assembly having a first portion that is rotatable with the rotor and a second portion that is stationary with the housing, the electromagnetic assembly converting the rotary motion to electricity as the first portion of the electromagnetic assembly rotates relative to the second portion of the electromagnetic assembly.

28. The lift fluid driven downhole electrical generator as recited in claim 27 further comprising a flow control device slidably disposed within the housing for selectively allowing and preventing the flow of lift fluid through the lift fluid port.

29. The lift fluid driven downhole electrical generator as recited in claim 28 further comprising an actuator operably coupled to the flow control device for varying the position of the flow control device relative to the lift fluid port.

30. The lift fluid driven downhole electrical generator as recited in claim 29 wherein the actuator further comprises a motor and a rotating element.

31. The lift fluid driven downhole electrical generator as recited in claim 27 further comprising a downhole telemetry system for wireless communication with the surface.

32. The lift fluid driven downhole electrical generator as recited in claim 27 further comprising a downhole sensor for sensing a formation fluid parameter.

33. The lift fluid driven downhole electrical generator as recited in claim 27 further comprising a downhole controller for sensing the electrical output of the downhole generator and adjusting the flowrate of the lift fluid to control the electrical output of the downhole generator.

34. The lift fluid driven downhole electrical generator as recited in claim 27 further comprising a downhole battery for storing an electrical charge.

35. The lift fluid driven downhole electrical generator as recited in claim 27 wherein the first portion of the electromagnetic assembly further comprises electrical windings and wherein the second portion of the electromagnetic assembly further comprises magnets.

36. The lift fluid driven downhole electrical generator as recited in claim 35 wherein one end of the electrical windings is electrically coupling to a first portion of a commutator and the other end of the electrical windings is electrically coupling to a second portion of the commutator.

37. The lift fluid driven downhole electrical generator as recited in claim 35 further comprising first and second contacts attached to the housing, the first contact member sequentially engaging the first portion of the commutator then the second portion of the commutator while the second contact member simultaneously sequentially engaging the second portion of the commutator then the first portion of the commutator.

38. A method for generating electricity downhole with a lift fluid driven downhole electrical generator comprising the steps of:

positioning the downhole electrical generator within a tubing string;

providing fluid pressure by injecting a lift fluid down an annulus surrounding the tubing string; and converting the fluid pressure to electricity.

39. The method as recited in claim 38 wherein the step of converting the fluid pressure to electricity further comprises impinging the lift fluid against a rotor to create rotary motion and converting the rotary motion to electricity by rotating a first portion of an electromagnetic assembly relative to a second portion of the electromagnetic assembly.

40. The method as recited in claim 38 further comprising the step of providing a fluid communication path through the downhole electrical generator by varying the position of a flow control device relative to a lift fluid port and communicating lift fluid therethrough.

41. The method as recited in claim 40 wherein the step of providing a fluid communication path through the downhole electrical generator by varying the position of a flow control device relative to a lift fluid port and communicating lift fluid therethrough further comprises energizing an actuator to vary the position of the flow control device relative to the lift fluid port.

42. The method as recited in claim 41 wherein the step of energizing the actuator to vary the position of the flow control device relative to the lift fluid port further comprises receiving a wireless command signal from the surface with a downhole telemetry system.

43. The method as recited in claim 41 wherein the step of energizing the actuator to vary the position of the flow control device relative to the lift fluid port further comprises generating a command signal in a downhole controller in response to a change in a formation fluid parameter sensed by a downhole sensor.

44. The method as recited in claim 41 wherein the step of energizing the actuator to vary the position of the flow control device relative to the lift fluid port further comprises generating a command signal in a downhole controller based upon a time schedule.

45. The method as recited in claim 41 wherein the step of energizing the actuator to vary the position of the flow control device relative to the lift fluid port further comprises receiving electrical power from a downhole battery.

46. The method as recited in claim 38 further comprising the step of sensing the generated electricity to determine the electrical output of the downhole electrical generator.

47. The method as recited in claim 46 wherein the step of sensing the generated electricity to determine the electrical output of the downhole electrical generator further comprises receiving a signal indicative of the magnitude of the electricity being generated with a controller, processing the signal in the controller and generating a control signal with the controller to vary the flowrate of the lift fluid.

* * * * *